US005217219A

United States Patent [19]

Chung et al.

[11] Patent Number: 5,217,219

[45] Date of Patent: * Jun. 8, 1993

[54] COMPACT SORTER FOR A COPY MACHINE

[75] Inventors: Jae H. Chung, Uijongbu-Shi; Soo Y. Kim, KangnamKu, both of Rep. of Korea

[73] Assignee: Sindo Ricoh Co., Ltd., Seoul, Rep. of Korea

[ * ] Notice: The portion of the term of this patent subsequent to Sep. 17, 2008 has been disclaimed.

[21] Appl. No.: 714,459

[22] Filed: Jun. 13, 1991

[30] Foreign Application Priority Data

Oct. 18, 1990 [KR] Rep. of Korea ..... 1990-16620

[51] Int. Cl.[5] ..... B65H 39/10

[52] U.S. Cl. ..... 271/293; 271/294

[58] Field of Search ..... 271/287, 288, 292, 293, 271/294

[56] References Cited

U.S. PATENT DOCUMENTS

| | | | |
|---|---|---|---|
| 4,328,963 | 5/1982 | DuBois et al. | 271/288 X |
| 4,332,377 | 6/1982 | DuBois et al. | 271/293 |
| 4,466,608 | 8/1984 | DuBois et al. | 271/293 |
| 4,466,609 | 8/1984 | Lawrence | 271/293 |
| 4,478,406 | 10/1984 | DuBois | 271/293 |
| 4,512,565 | 4/1985 | Matsumoto et al. | 271/293 X |
| 4,671,505 | 6/1987 | Hidaka | 271/293 |
| 4,778,171 | 10/1988 | Hidaka | 271/293 |
| 4,854,571 | 8/1989 | Kitajima et al. | 271/293 |
| 4,872,663 | 10/1989 | Latone | 271/292 X |
| 4,911,424 | 3/1990 | Lawrence | 271/293 |
| 5,048,820 | 9/1991 | Chung et al. | 271/293 |

FOREIGN PATENT DOCUMENTS

| | | | |
|---|---|---|---|
| 0043767 | 3/1984 | Japan | 271/287 |
| 0172358 | 9/1984 | Japan | 271/293 |
| 0031469 | 2/1985 | Japan | 271/293 |
| 0223764 | 11/1985 | Japan | 271/293 |
| 60-232370 | 11/1985 | Japan . | |
| 0013368 | 1/1989 | Japan | 271/287 |
| 0231766 | 9/1989 | Japan | 271/292 |
| 90-18264 | 11/1990 | Rep. of Korea . | |
| 89-8291 | 1/1991 | Rep. of Korea . | |
| 2168037 | 6/1986 | United Kingdom . | |

OTHER PUBLICATIONS

RICOH photographs which show a sorter having a pair of auxiliary hooks at both side plates of the sorter, 2 sheets, each of 4 pictures.

*Primary Examiner*—H. Grant Skaggs
*Assistant Examiner*—Carol Lynn Druzbick
*Attorney, Agent, or Firm*—Darby & Darby

[57] ABSTRACT

A compact sorter for a copy machine generally comprising a rotatable transfer wheel, an ejecting section for ejecting copies, a slot liner having first and second vertical portions connected by a middle portion which extends relative to the vertical portions toward the ejecting section in a radius of gyration of the transfer wheel, and a plurality of bin trays each capable of moving along the slot liner toward the ejecting section for receiving the copies, each said bin tray having a pair of space controlling cams 6 which comprise upper and lower space controlling arms 7,8 and are symmetrically provided at both side outer ends of said bin tray for maintaining predetermined upper and lower spaces with another upper and lower bin trays during movement for receiving copy from said ejecting section.

5 Claims, 5 Drawing Sheets

COMPACT SORTER FOR A COPY MACHINE

BACKGROUND OF THE INVENTION

1. Field of The Invention

The present invention relates to a compact sorter for a copy machine, and more particularly to a compact sorter including an improved slot liner and space controlling cams for controlling the spaces among the bin trays, thereby causing the bin to smoothly move along the slot liner.

2. Description of The Prior Art

Generally, there has been a known sorter for copy machine such as a sorter disclosed in U.S. Pat. No. 4,466,608 which included a vertical linear slot liner, as shown in FIG. 1. However, it has been noted that the sorter of such a type had a drawback that the bin tray 3 could not advance closer to the ejecting section of the copy machine so that the ejected copies from the ejecting section might not be securely received thereby, while there was no problem in upward and lowerward movement thereof along the slot liner.

There has been, therefore, proposed another type of sorter having a inclined slot liner as shown in FIG. 2 in order to solve the above-mentioned drawback. The sorter of this type comprised a slot liner formed as inclined at a portion overlapped by the transfer wheel 2, thereby solving the above-mentioned drawback that the bin tray 3 could not advance closer to the ejecting section of the copy machine by providing a capability of advancing in a distance lo to the ejecting section. However, it has been noted the sorter of this type had another disadvantage that each bin tray 3 including a L-shaped cam 66 mounted to a free outer end thereof as shown in FIG. 3 could not maintain an predetermined space with another lower tray during a movement thereof toward the ejecting section of the copy machine, while it was possible to secure a space with the upper tray, as shown in FIG. 2. That is to say, as a middle bin tray moved toward the ejecting section of the copy machine by upward sliding movement of the pins thereof, interlocking with the rotatable transfer wheel 2, along a rightward and upward inclined portion of the slot liner, another lower bin tray contacted therewith might drop downward so that the dropped tray might occur a interference with the copies, such as a jamming of the copies during receiving them.

SUMMARY OF THE INVENTION

It is, therefore, an object of the present invention to provide a compact sorter for copy machine including bin trays each having space controlling cams mounted at both side outer ends thereof for controlling and maintaining predetermined spaces with upper and lower trays during its movement along an upward inclined portion of the slot liner, thereby solving the drawback encountered in the conventional sorter having a known L-shaped cam.

It is another object of the present invention to provide a compact sorter including a slot liner having an improved inclined shape, that is to say, having a rightward and upward inclined portion comprising two parts formed as inclined two times.

In one aspect, the present invention provides a compact sorter for a copy machine comprising a rotatable transfer wheel, an ejecting section for ejecting copies, a slot liner having first and second vertical portions connected by a middle portion which extends relative to the vertical portions toward the ejecting section in a radius of gyration of the transfer wheel, and a plurality of bin trays each capable of moving by means of a pin sliding along the slot liner toward the ejecting section for receiving the copies, wherein each said bin tray having: a pair of space controlling cams which comprise upward and lowerward protruding space controlling arms and are symmetrically provided at both side outer ends of said bin tray for controlling and maintaining predetermined upper and lower spaces with another upper and lower bin trays during movement for receiving copies from said ejecting section.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
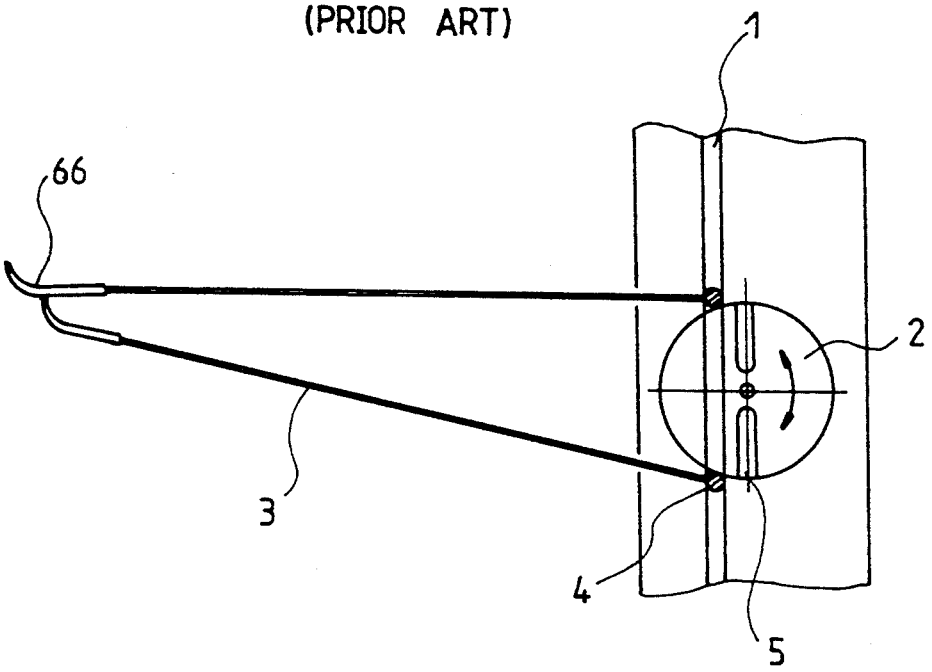
FIG. 1 (PRIOR ART)
FIG. 1 is a view corresponding to FIG. 8, but showing a sorter having a vertical linear slot liner in accordance with the prior art.
Figure 2:
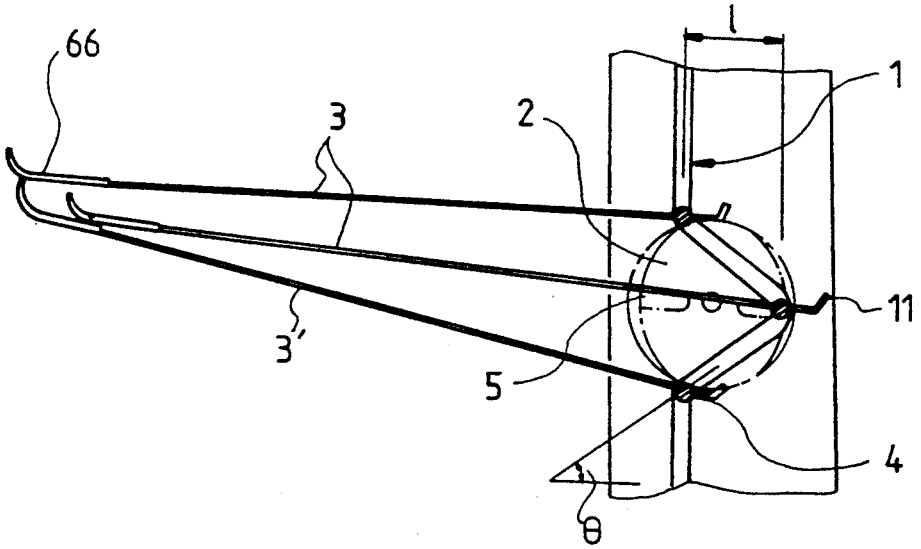
FIG. 2 (PRIOR ART)
FIG. 2 is a view corresponding to FIG. 8, but showing the prior art.
Figure 3:
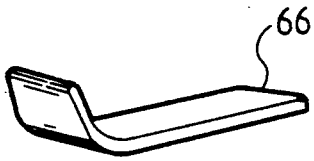
FIG. 3 (PRIOR ART)
FIG. 3 is a view corresponding to FIG. 4, but showing a L-shaped cam in accordance with the prior art.
Figure 4:
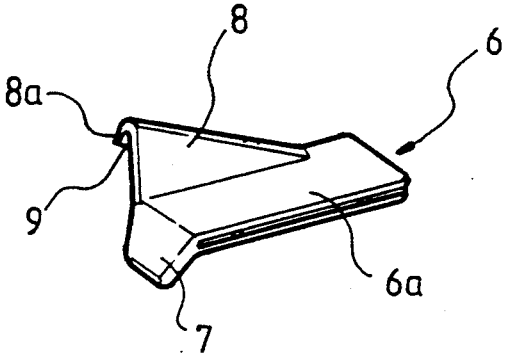
FIG. 4 is a perspective view of a space controlling cam in accordance with the invention.
Figure 6A:
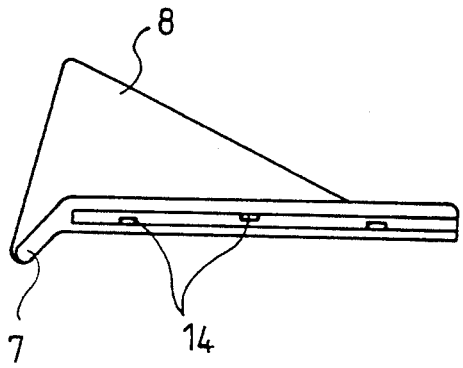
FIG. 6A is a side view of the space controlling cam of FIG. 4.
Figure 7:
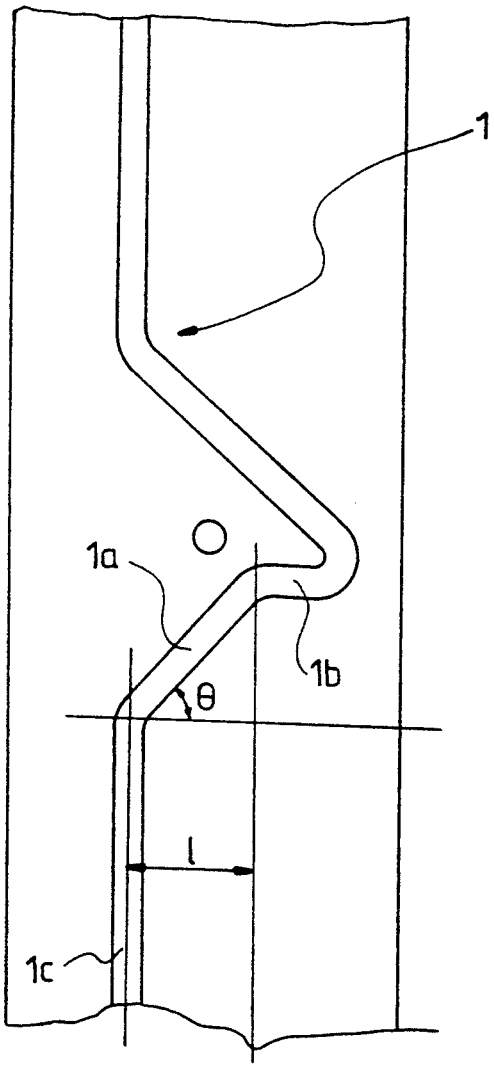
FIG. 7 is a view of a slot liner in accordance with the present invention.
Figure 8:
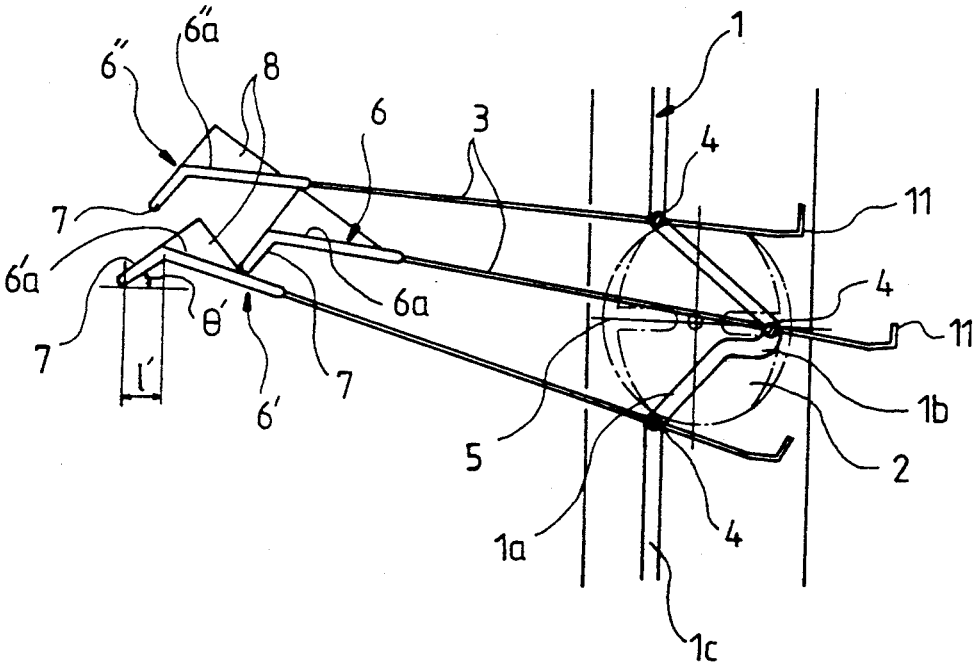
FIG. 8 is a partially side view showing the operation of the compact sorter including the slot liner of FIG. 7.

Referring now to FIGS. 7 and 8 which respectively show a slot liner in accordance with the present invention, and the operation of the compact sorter including the slot liner of FIG. 7, the compact sorter for a copy machine generally comprising a rotatable transfer wheel 2, an ejecting section for ejecting copies, a slot liner 1 having first and second vertical portions connected by a middle portion which extends toward the ejecting section in a radius of gyration of the transfer wheel 2, and a plurality of bin trays 3 each capable of moving by means of a pair of pins 4 engaged with the slot liner 1 toward the ejecting section for receiving the copies, each said bin tray 3 having a pair of space controlling cams 6 which comprise lowerward and upward protruding space controlling arms 7, 8 and are symmetrically provided at both side outer ends of said bin tray 3 for maintaining predetermined upper and lower spaces with another upper and lower bin trays during movement for receiving copies from said ejecting section of the copy machine. As shown in FIG. 4 and 6A, each upward protruding space controlling arm 8 has a triangular shape having one longer side relative to another sides, said relatively longer side aligned in a line with a plane surface of said bin tray 3 so that the there may not happen a frictional resistance between two trays 3. Additionally, the upward protruding space controlling arm 8 has a flap 8*a* formed outward for preventing rightward and leftward movement of said bin tray 3 in moving, thereby causing a smooth and stable movement of the bin tray 3 to be accomplished. Also, the lowerward protruding space controlling arm 7 which is adapted for maintaining predetermined space with another lower bin tray 3 is capable of varying its lowerward length according to volume of the copies, thereby making it possible to control the space between two bin trays 3. In result, the bin tray 3 can receive copies irrespective of volume of the copies.

Additionally, to ameliorate the effect of the cams 6, the first part of the middle portion formed as inclined toward the ejecting section from the first vertical portion 1*c*, that is, the lower vertical portion of the slot liner 1, said middle portion extended relative to the vertical portions toward the ejecting section of copy machine in a radius of gyration of the transfer wheel 2, comprises first and second bending parts 1*a* and 1*b* formed as inclined two times and adapted for minimizing an interference between cams of an upward moving bin tray and a lower awaiting bin tray during an advancing movement of the moving tray toward said ejecting section, as shown in FIG. 7. At this time, it is desirable to so construct the first bending part 1*a* formed as inclined toward the ejecting section from the lower vertical portion 1*c* that an inclination angle $\theta$ and a horizontal length l thereof are equal to an inclination angle $\theta'$ and a horizontal length l' of the lower space controlling arm 6*a* of the space controlling cam 6, 6' and 6''. Also, it may be possible to construct the inclination angle $\theta$ and horizontal length l of the first bending part 1*a* in order to be relatively more rapid in inclination and longer than those of the lower space controlling arm 6*a* as occasion demands.

In the drawings, the reference numerals 11 and 14 designate a stacker of the bin tray 3 and a plurality of locking pins of the cam 6, respectively, said locking pins 14 adapted for providing a stable and fixed connection between the bin tray 3 and the cam 6.

The compact sorter according to invention having the above-mentioned construction will be described as to its operation and effect.

Figure 5:
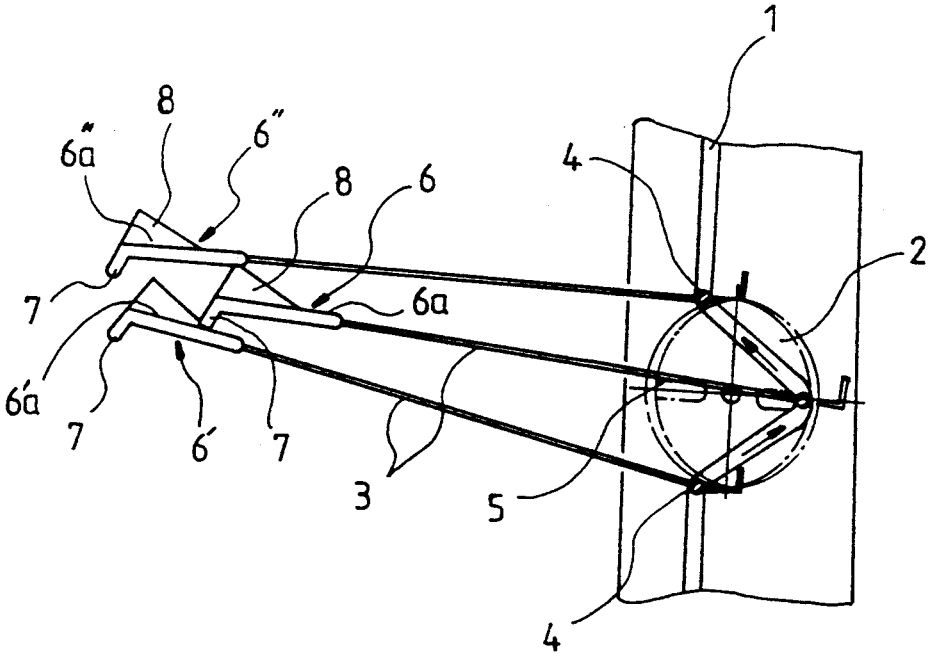
FIG. 5 is a view corresponding to FIG. 8, but showing another embodiment of bin trays each including the space controlling cams of FIG. 4.

Turning now to FIG. 5, as waiting bin tray 3 starts to move slantly and upwardly toward the ejecting section of the copy machine by means of pins 4 sliding along the middle portion of the slot liner 1 in order to receive the ejected copies, the space controlling cams 6 mounted at the both side outer ends of the bin tray 3, simultaneously, slide to move. At this time, the lower space controlling arm 7 of the moving cam 6 is first located on the base 6'*a* of another cam 6' of the lower bin tray 3, thereafter starts to move horizontally and inwardly along the base 6'*a*, thereby securing a space corresponding to a height of the arm 7 with the lower bin tray 3. Also, the upper space controlling arm 8 of the moving cam 6 pulls upwardly another cam 6'' of the upper bin tray 3 as it moves. Thus, there is usually secured to the moving tray 3 a space being equal to the added height of the lower and upper arm 7 and 8 between the upper and lower bin trays 3 so that the receiving of the copies can be stably accomplished. Furthermore, the moving tray 3 can move without any interference with the another copies already received on the lower tray 3.

Here, the desired space for the moving bin tray 3 between the waiting bin trays 3 corresponding to the horizontal moving distance of the moving tray 3 can be controlled by controlling the inclination angles of the lower and upper space controlling arms 7 and 8 of the cam 6. Also, as the moving tray 3 after receiving the ejected copies from the ejecting section moves upwardly and slantly away from the ejecting section, the upper space controlling arm 8 thereof also moves inserting into a setting groove 9 under the flap 8*a* of the cam 6 of the upper bin tray 3 in order to gradually reduce the space therebetween. Hence, the bin tray 3 can secure an accurate and stable upward and lowerward movement without any displacement thereof in right and left directions.

In addition, to ameliorate the operational effect of this compact sorter, the first inclined part of the middle portion of the slot liner 1 comprises a first bending part 1*a* and a second bending part 1*b* respectively formed as inclined two times in order to providing relatively rapider inclination angle $\theta$ and longer length l therefor. Thus, the friction which may be present between the cams 6 of the trays 3 can be reduced to a minimum grade, that is to say, the interference between the lower space controlling arms 7 according to the inclination angles thereof.

If more specifically described, upon having an inclination angle $\theta$ of the first bending part 1*a* which has more rapid inclination than or is equal to that $\theta'$ of the lower space controlling arm 7 of the cam 6, the upward movement angle of the pin 4 of the bin tray 3 (said pin 4 moving along the first bending part 1*a* of the slot liner 1) has more rapid inclination that or is equal to the inclination angle of the lower space controlling arm 7 of the cam 6. Also, upon a horizontal length l of the first bending part 1*a* which is longer than or equal to the horizontal length l' of the lower space controlling arm 7, the lower space controlling arm 7 of the cam 6 of the moving tray 3 will accomplish its ascending movement along another one 7 of the lower bin tray 3 during upward movement of the pin 4 of the moving tray along the first bending part 1*a* of the slot liner 1, thereafter, simply and horizontally moves along the base 6'*a* of the cam 6 during the movement of the pin 4 along the second bending part 1*b* of the slot liner 1. Hence, an interference which may be present between the cams 6 during the movement of the bin trays 3 can be reduced to the minimum grade, thereby securing a smooth movement of the bin tray 3.

In the same procedure, the same effect can be obtained in the downward movement of the bin trays 3 after accomplishing the receiving of the copies.

Figure 6B:
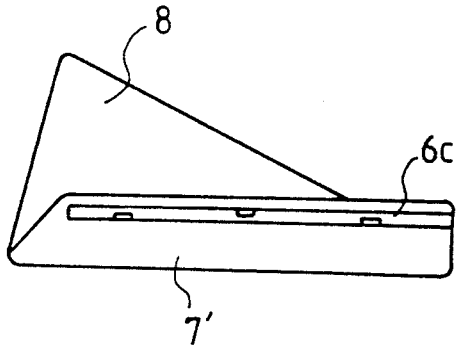
FIG. 6B is a view corresponding to FIG. 6A, but showing other embodiment of a space controlling cam in accordance with the invention.

On the other hand, as shown in FIG. 6*b*, the space controlling cam may be constructed so that there may be provided a lower space controlling arm 7' having a horizontal under surface instead of the lowerward protruding arm 7. The space controlling cam 6*c* with the controlling arm 7' can provide the similar effect controlling and maintaining the space with another lower bin tray 3 for the moving bin tray 3.

As described above, the compact sorter according to the present invention includes bin trays each having a pair of space controlling cams which is provided at the both side outer ends thereof and adapted for securing desired spaces among the moving bin tray for receiving copies and the waiting upper and lower bin trays, each said controlling cam provided with upward and lowerward protruding arms, thereby securing the smooth movement of the bin tray and preventing the interference of the bin tray with the copies, such as jamming of the copies, in receiving the copies, and also providing an accommodation for the relatively larger volume of the copies for the bin tray. Additionally, the compact sorter is provided with a slot liner having an upward and rightward inclined portion comprising two parts, a first bending part having an inclination angle, a second part formed from the last end of the first bending part to the start end of the upward and leftward inclined portion of the slot liner, thereby reducing the interference between the cams to the minimum grade during the movement of the bin tray. Thus, the present invention can provide a compact sorter having an advanced performance for separating the copies.

Although the preferred embodiment of the invention has been disclosed for illustrative purpose, those skilled in the art will appreciate that various modifications, additions and substitutions are possible, without departing from the scope and spirit of the invention as disclosed in the accompanying claims.

What is claimed is:

1. A compact sorter for a copy machine comprising a rotatable transfer wheel which has a radius of gyration, an ejecting section for ejecting copies, a slot liner having first and second vertical portions connected by a middle portion which extends relative to the vertical portions toward the ejecting section in the radius of gyration of the transfer wheel, and a plurality of bin trays each capable of moving along the slot liner toward the ejecting section for receiving the copies, characterized by:

each said bin tray having a pair of space controlling cams which comprise upper and lower space controlling arms and are symmetrically provided at both side outer ends of said bin tray for maintaining predetermined upper and lower spaces with additional upper and lower bin trays during movement for receiving copy from said ejecting section, said upper space controlling arm having a triangular shape with one side relatively longer than other sides of the triangular shape, said upper space controlling arm having a flap extending outward for preventing rightward and leftward movement of said bin tray, said lower space controlling arm having a lowerward protruding arm portion extending from the front end of said space controlling cam.

2. A compact sorter as in claim 1, wherein at least one of said space controlling cams have a plurality of locking pins.

3. A compact sorter for a copy machine comprising a rotatable transfer wheel which has a radius of gyration, an ejecting section for ejecting copies, a slot liner having first and second vertical portions connected by a middle portion which extends relative to the vertical portions toward the ejecting section in the radius of gyration of the transfer wheel, and a plurality of bin trays each capable of moving along the slot liner toward the ejecting section or receiving the copies, characterized by:

each said bin tray having a pair of space controlling cams which comprise upper and lower space controlling arms and are symmetrically provided at both side outer ends of said bin tray for maintaining predetermined upper and lower spaces with additional upper and lower bin trays during movement for receiving copy from said ejecting section, said upper space controlling arm having a triangular shape with one side relatively longer than the other sides, said upper space controlling arm having a flap extending outward for preventing rightward and leftward movement of said bin tray, said lower space controlling arm having an arm with a horizontal under surface extending from a front end to a rear end of said space controlling cam.

4. A compact sorter for a copy machine comprising a rotatable transfer wheel which has a radius of gyration, an ejecting section for ejecting copies, a slot liner having first and second vertical portions connected by a middle portion which extends relative to the vertical portions toward the ejecting section in the radius of gyration of the transfer wheel, and a plurality of bin trays each capable of moving along the slot liner toward the ejecting section for receiving the copies, characterized by:

each said bin tray having a pair of space controlling cams which comprise upper and lower space controlling arms and are symmetrically provided at both side outer ends of said bin tray for maintaining predetermined upper and lower spaces with additional upper and lower bin trays during movement for receiving copy from said ejecting section, said upper space controlling arm having a triangular shape with one side relatively longer than the other sides, said upper space controlling arm having a flap extending outward for preventing rightward and leftward movement of said bin tray, said lower space controlling arm having a lowerward protruding arm portion extending from the front end of said space controlling cam, the middle portion of the slot liner comprising a first part upwardly sloping toward the ejecting section and a second part upwardly sloping away from the ejecting section, and a plurality of bin trays each capable of moving along the slot liner toward the ejecting section for receiving the copies, and said first part of the middle portion of the slot liner comprising first and second bending parts for minimizing an interference between cams of an upward moving bin tray and a lower bin tray.

5. A compact sorter for a copy machine comprising a rotatable transfer wheel which has a radius of gyration, an ejecting section for ejecting copies, a slot liner having first and second vertical portions connected by a middle portion which extends relative to the vertical portions toward the ejecting section in the radius of gyration of the transfer wheel, and a plurality of bin trays each capable of moving along the slot liner toward the ejecting section for receiving the copies, characterized by:

each said bin tray having a pair of space controlling cams which comprise upper and lower space controlling arms and are symmetrically provided at both side outer ends of said bin tray for maintaining predetermined upper and lower spaces with additional upper and lower bin trays during movement for receiving copy from said ejecting section, said upper space controlling arm having a triangular shape with one side relatively longer than the other sides, said upper space controlling arm having a flap extending outward for preventing rightward and leftward movement of said bin tray, said lower space controlling arm having a lowerward protruding arm portion extending from the front end of said space controlling cam, said first bending part having an inclination angle $\theta$ and a horizontal length 1 corresponding to an inclination angle $\theta'$ and a horizontal length 1' of said lower space controlling arm of the space controlling cam an inclination angle $\theta$ which is at least equal in inclination to the inclination $\theta'$ of said lower space controlling arm of said space controlling cam.

* * * * *